US005150896A

United States Patent [19]

Holmes

[11] Patent Number: 5,150,896

[45] Date of Patent: Sep. 29, 1992

[54] GAME RACKET WITH INCURVATE CONTACT SURFACES

[76] Inventor: David Holmes, 17577 Johnson Ave., Sonoma, Calif. 95476

[21] Appl. No.: 845,393

[22] Filed: Mar. 3, 1992

[51] Int. Cl.[5] ..... A63B 49/00
[52] U.S. Cl. ..... 273/67 R; 273/73 C
[58] Field of Search ..... 273/67 R, 67 D, 67 DC, 273/73 R, 73 C, 73 L, 76

[56] References Cited

U.S. PATENT DOCUMENTS

| | | | |
|---|---|---|---|
| D. 232,450 | 8/1974 | Chreist et al. | 273/73 R X |
| D. 237,990 | 12/1975 | Gillespie et al. | 273/73 C X |
| D. 260,671 | 9/1981 | Lau | 273/73 R X |
| 3,162,443 | 12/1964 | Petri | 273/73 L |
| 3,879,035 | 4/1975 | Danchulis et al. | 273/73 C |
| 3,934,876 | 1/1976 | Haddad | 273/73 C |
| 4,062,541 | 12/1977 | Marks | 273/73 R X |
| 4,079,935 | 3/1978 | Gormley | 273/67 R |
| 4,128,239 | 12/1978 | Grenadier | 273/67 R |
| 4,130,277 | 12/1978 | Marks | 273/67 R |
| 4,147,348 | 4/1979 | Lee | 273/73 C |
| 4,151,995 | 9/1979 | Weed | 273/73 C |
| 4,262,903 | 4/1981 | Naret | 273/67 R |
| 4,346,891 | 6/1982 | Epstein | 273/73 C |
| 4,411,427 | 10/1983 | Baumgartner | 273/67 R |
| 4,802,678 | 2/1989 | Svoma | 273/73 C X |

FOREIGN PATENT DOCUMENTS

| | | | |
|---|---|---|---|
| 0178843 | 6/1954 | Austria | 273/73 C |
| 2067079 | 7/1981 | United Kingdom | 273/67 D |

OTHER PUBLICATIONS

"Honeycomb Racket for Phys. Ed Badminton", *The Sporting Goods Dealer,* Jun. 1981, p. 106.
"Vulcanized Edge Improves Paddles", *The Sporting Goods Dealer,* Dec., 1977, p. 125.

*Primary Examiner*—Vincent Millin
*Assistant Examiner*—William E. Stoll

[57] ABSTRACT

A game racket (20) having rigid, incurvate contact surfaces (29) with apertures (52) for the passage of air rather than the conventional network of stringing, both contact surfaces (29) having a continuous, smooth corrective curvature able to automatically compensate for the lateral and longitudinal torsional forces that are exerted by an incoming ball (56) onto the racket (20), when a player fails to hit the ball dead center on the racket face. Having no stringing, the racket of the present invention is completely maintenance-free and provides numerous other advantages over conventional racket designs, including: texturable contact surfaces (38); a variety of aperture (52) shapes and patterns with aerodynamic fairing (53); contact surfaces (29) whose playable area extends to their extreme periphery (31 and 33); means for employing vibration-dampening and shock absorbant materials in the racket's construction; and a curvature which aids in the execution of "slice" shots. An alternative design allows the two contact surfaces (43 and 44) to have differentiated curvatures and textures (39, 40, 41, 42, 54 and 55) for forehand and backhand shots. Insofar as the racket (20) itself compensates for all torsional forces, it can be gripped more loosely in the hand, and should reduce the incidence of "tennis elbow."

20 Claims, 7 Drawing Sheets

GAME RACKET WITH INCURVATE CONTACT SURFACES

BACKGROUND OF THE INVENTION

The invention relates to game rackets of the type having a grip, a handle shaft and a head with two contact surfaces, such as for instance a tennis racket, a squash racket, a badminton racket or a racket ball racket.

Game rackets are used in a variety of sports, including tennis, badminton, squash, racket ball and ping-pong. The contact surfaces of a conventional true racket, as distinguished from the solid surfaces of a paddle, are formed by a network of flexible string under high peripheral tension.

In games such as tennis—where the ball employed is of considerable mass, and the velocities achieved, especially in tournament play, are also very great—the ball is capable of exerting a significant torsional force on the player's wrist, if it is not hit dead center on the racket's face. The area which creates a minimal amount of torque and thus allows the player to aim the ball with greater precision and force is located in the central portion of the racket's face and is referred to as the "sweet spot." Much of the prior art relating to improved racket design attempts in various ways to enlarge the effective sweet spot area. This has led recently to the introduction of a variety of "oversized" racket designs into tournament play.

Some prior art inventions, such as U.S. Pat. No. 4,147,348 (Lee), have provided means for increasing the player's ability to counteract the torsional forces—in this case by bringing the contact surfaces downward such that they are essentially an extension of the forearm itself. However, no arrangement can completely do away with the torsional forces—they are a physical fact of nature. A combination of such design elements as are found in U.S. Pat. No. 4,147,348 (Lee), above, and the present invention may represent an optimal solution.

OBJECTS AND ADVANTAGES

The present invention provides means for designing a racket with a larger sweet spot without expanding the racket's overall size and weight to ridiculous proportions. This new design concept opens up many possibilities for radically improving upon the conventional form of the racket—the shape and texture of its contact surfaces, as well as the aerodynamic properties of the racket as a whole. It will also allow many of the recently developed plastics, composites and lightweight metal alloys to be employed in new ways to greatly improve the racket's performance.

One of the objects of the present invention is to provide a game racket in which the contact surfaces are composed of a resilient, lightweight material, of a design similar to that found in U.S. Pat. No. 3,934,876 (Haddad); that is to say, cast or machined into an open cellular network or honeycomb-like matrix which derives its strength and resiliency from the relative thickness of the matrix itself, and its lightness and minimal air resistance from the hollow channels that connect the two contact surfaces. This is in contrast to a conventional racket, whose contact surfaces are formed by a network of woven gut or synthetic filament stringing that gains its resiliency through peripheral tension applied to it by a surrounding rigid bow.

However, instead of the planar or flat contact surfaces indicated in the patent cited immediately above, the present invention would give each of the front and back contact surfaces a concave, approximately parabolic curvature. The purpose of this curvature is to provide means for the racket itself to automatically compensate for the torsional forces that are exerted upon it by an incoming ball, when the player fails to hit the ball dead center. With a conventional racket, these torsional forces cause the plane of the contact surface to be shifted away from the intended angle of impact, throwing the entire contact surface into severe misalignment, and causing the ball to rebound in an unpredictable trajectory.

The parabolic curvature of the lateral portions of the contact surfaces of the present invention provide an automatic compensation for the lateral torsional force caused by an inaccurate hit in the following manner. The racket is shaped such that an incoming ball, hitting the contact surface somewhat off center, expends its kinetic energy applying a torsional force which twists the racket away from the intended plane of contact. Once all of the ball's kinetic energy is expended, however, the racket will have been automatically readjusted by the torsional force itself such that it will be presenting its curved surface to the ball at a point whose tangent plane is once again identical to the intended plane of contact.

A ball hit dead center would cause no lateral torque, and thus the angle of presentation in this area would be the same as for a conventional racket—it would be perfectly flat. The farther from the central longitudinal axis the ball is hit, the greater the torsional force that is encountered—the more precipitous would be the curvature, and the more the racket would automatically compensate. Effectively, the sweet spot has been expanded to include the entire surface of the racket.

In designing the correct curvature for the present invention, many factors must be taken into consideration. Theoretically, the torsional force is equal to the force applied by the ball times the length of the lever arm (in this case the distance from the point of contact to the central longitudinal axis of the racket face). Therefore, one might assume that a simple linear increase in the angle of the tangent plane to the curved surface as a function of the distance of the point of contact from the central longitudinal axis of the racket face would be ideal.

However, discovering the optimal design, in practice, will require a thorough analysis of the interrelationship between all of the forces involved: the mass and average velocity of the ball, the momentum of the racket and the forces applied to the grip by the wrist and forearm. Even such minute forces as the slight spin which will be put on the ball as it contacts the curved surface and the physiological response time of the player must be taken into account. Therefore, it will only be through extensive empirical testing and a great deal of trial and error that the ideal curvature will be determined. It may be determined that a considerable portion of the center of the racket face should remain perfectly flat, and that the corrective curvature should begin closer to the lateral edges.

Additionally, the present invention includes a similar compensatory curvature in the contact surface for a secondary torsional force which increases as the point of contact approaches the extreme end of the racket farthest from the grip—the distance along the longitudinal axis from the grip to the point of contact representing the lever arm in this case. The exact curvature to adequately compensate for this longitudinal torque force must also be determined empirically through experimentation.

Although one might not assume that a single racket could be designed to provide adequate compensation for every player from rank beginner to advanced tournament competitor, there are some indications that this may indeed be so. Assuming that we are speaking only of games between players of roughly equal strength, one can see that both the velocity that the ball achieves during play (and the consequent torsional forces that it can exert on the racket) as well as the ability of the players to resist those torsional forces (with the muscles of their forearm and wrist) depend upon the same variable: the physical strength of the players involved. Consequently, a weaker player's racket will twist more easily in his hand, but the slower moving ball will create a proportionally weaker torsional force.

One great advantage of the present invention which is not at first apparent arises from the fact that the player no longer has to try so desperately to counter the torsional forces acting upon his racket by maintaining an excessive tension in his wrist and forearm. The player will be able to hold the racket in a much more relaxed manner, secure in the knowledge that the twisting of the racket is part of its normal process of self-correction. This may decrease the intensity of the muscular stresses which often result in the painful and debilitating condition known as "tennis elbow."

One distinct advantage of doing away with the conventional string surface is that there is no longer a need for the massive peripheral bow which supports it. Since in a conventional racket the bow must necessarily extend a considerable height above the contact surfaces, a large area of the racket head, including the bow itself and the inch or so of peripheral string surface abutting it, is completely unusable. A ball hitting anywhere in this area rebounds in a wild, unpredictable trajectory. In the present invention, since the entire contact surface can be designed to be completely self-supporting, with all structural members occupying the space between the two concave faces, the parabolic curvature can extend to the very edge of the racket, maximizing the effective playing area.

In the present invention, the possibility of the contact surface and the surrounding frame being made of different materials, joined by an intermediate layer of vibration-dampening material, has also been explored. In such a case, the contact surface could have some "give" to it, approximating the "trampoline effect" of a conventional racket, while maintaining the advantages of the compensatory curvature. The racket itself would be made of a stiffer material, and a vibration-dampening layer in between them would help to minimize the deleterious effects of excessive vibrations on the joints of the wrist and arm.

A further variation of the design outlined in the last paragraph is possible in which the contact surface is a pliant membrane of variable thickness conforming to the above mentioned curvature, which is kept taut by being joined to the surrounding frame structure under high peripheral tension.

The racket of the present invention can of course also utilize any of the recently developed materials which are now commonly used in the manufacture of game rackets, many of which possess excellent shock absorbency characteristics and others that are actually able to sense the velocity of an incoming ball and respond with an appropriate amount of "give."

A further improvement vis-a-vis U.S. Pat. No. 3,934,876 (Haddad) in the present invention is the shape of the cross-section of the strips which form the cellular network. Instead of the squared-off lozenge shape which is indicated in the prior art claims, those of the present invention have an aerodynamic ovoid cross-section, like that of an airplane wing. This helps stabilize the swing and greatly reduces air resistance.

Alternatively, if one desires to leave more of the contact surface solidly intact by decreasing the size of the apertures, it can then be textured in various ways to facilitate the execution of certain trick shots, such as adding top spin or backspin to the ball. It may be found through experimentation that it is beneficial for the lateral areas to be textured differently from the center, or for the extreme end to be textured differently from the area near the throat. It is also believed that the parabolic curvature of the contact surface itself can be exploited to allow more prolonged contact with the ball and thus greater control when one is attempting to put backspin or top spin on the ball with a slice shot. In this case the apertures could be of any conceivable shape and have leading edges with aerodynamic fairing.

A further object of an alternative design of the present invention is to provide a racket whose two contact surfaces are designed with different curvatures and textures—one to be used exclusively for forehand shots and the other to be used for backhand. Again, the specific design details for such a racket could only be determined through experimentation, although it is obvious that the muscles used in the execution of backhand shots are considerably weaker than those employed in forehand shots and would necessitate a greater compensatory curvature.

It is clear from the text of the section entitled "Background of the Invention" in U.S. Pat. No. 3,934,876 (Haddad) that the inventor intended nothing more than a method of producing inexpensive, long-lasting, easily manufactured rackets. However, it is now possible, using today's panoply of lightweight, high tensile strength polymers and metallic alloys (such as graphite composites, carbon reinforced plastics and ceramics), to fabricate a racket with this corrective curvature which far surpasses those of the conventional configuration. Additionally, this new generation of rackets would be completely maintenance-free, with no need for periodic restringing to counter the inevitable slackening of the string surface due to the constant tension under which it is held—an inconvenient and expensive drawback to all conventional racket designs. Nor would there be a need for players to continually readjust the meshwork of stringing as it works its way out of alignment during play.

Accordingly, several objects and advantages of the present invention are:

(a) to provide a game racket composed entirely of one or several resilient, lightweight materials such as graphite composites, carbon reinforced plastics, ceramics or metallic alloys, obviating the need for string-webbed contact surfaces;

(b) to provide a game racket with a larger "sweet spot" area without further expansion of the racket-'overall size or weight;

(c) to provide a game racket whose open cellular, honeycomb-like contact surface structure ensures low swing weight (torsional inertia) and minimal wind resistance;

(d) to provide a game racket whose honeycomb-like contact surfaces are formed from interconnected strips with an aerodynamic, ovoid cross-section;

(e) to provide a game racket whose incurvate contact surfaces are able to automatically compensate for the torsional forces applied to the racket by an incoming ball hitting anywhere on either contact surface;

(f) to provide a game racket with a secondary compensatory curvature in the lengthwise direction to automatically adjust for the secondary torsional force encountered when the ball is hit too far toward the extreme end of the playing surface from the racket's grip end;

(g) to provide a game racket whose compensatory properties allow the same or a similar design to be used by players of all levels of expertise, regardless of their strength;

(h) to provide a game racket which can be held in a more relaxed manner, since the player no longer needs to resist the torsional forces in order to aim accurately, thus decreasing the muscular stresses which often result in injury;

(i) to provide a game racket which does not necessitate a cumbersome frame extending above the contact surfaces, able to withstand the extreme peripheral tension of the stringing;

(j) to provide a game racket whose contact surfaces extend to the very edge of the racket face and whose supporting structures occupy the space between the concave surfaces;

(k) to provide a game racket whose solid contact surfaces can be textured in any conceivable manner to assist the player in the execution of shots involving backspin and top spin;

(l) to provide a game racket in which the contact surface is made of a material with more elasticity than the frame of the racket and is joined to the racket frame by an intermediate layer of vibration-dampening material;

(m) to provide a game racket of an alternative design whose contact surface is a pliant membrane of variable thickness conforming to the above mentioned curvature, held taut by being fastened to the surrounding frame structure under high peripheral tension;

(n) to provide a game racket of an alternative design in which the two contact surfaces have different curvatures and textures—one optimally designed for forehand shots and the other for backhand;

(o) to provide a game racket whose parabolic curvature can be exploited to allow a smoother and more prolonged contact with the ball and thus greater control in the execution of shots involving backspin and top spin; and (p) to provide a game racket which is maintenance-free, with no need for periodic restringing or for a player to be continually readjusting the crisscrossing string as it works its way out of alignment during play.

Further objects and advantages will become apparent from a consideration of the ensuing description and drawings.

BRIEF DESCRIPTION OF THE DRAWINGS

Preferred forms of the invention are described below with reference to the accompanying drawings in which.

REFERENCE NUMERALS IN THE DRAWINGS

Figure 1:
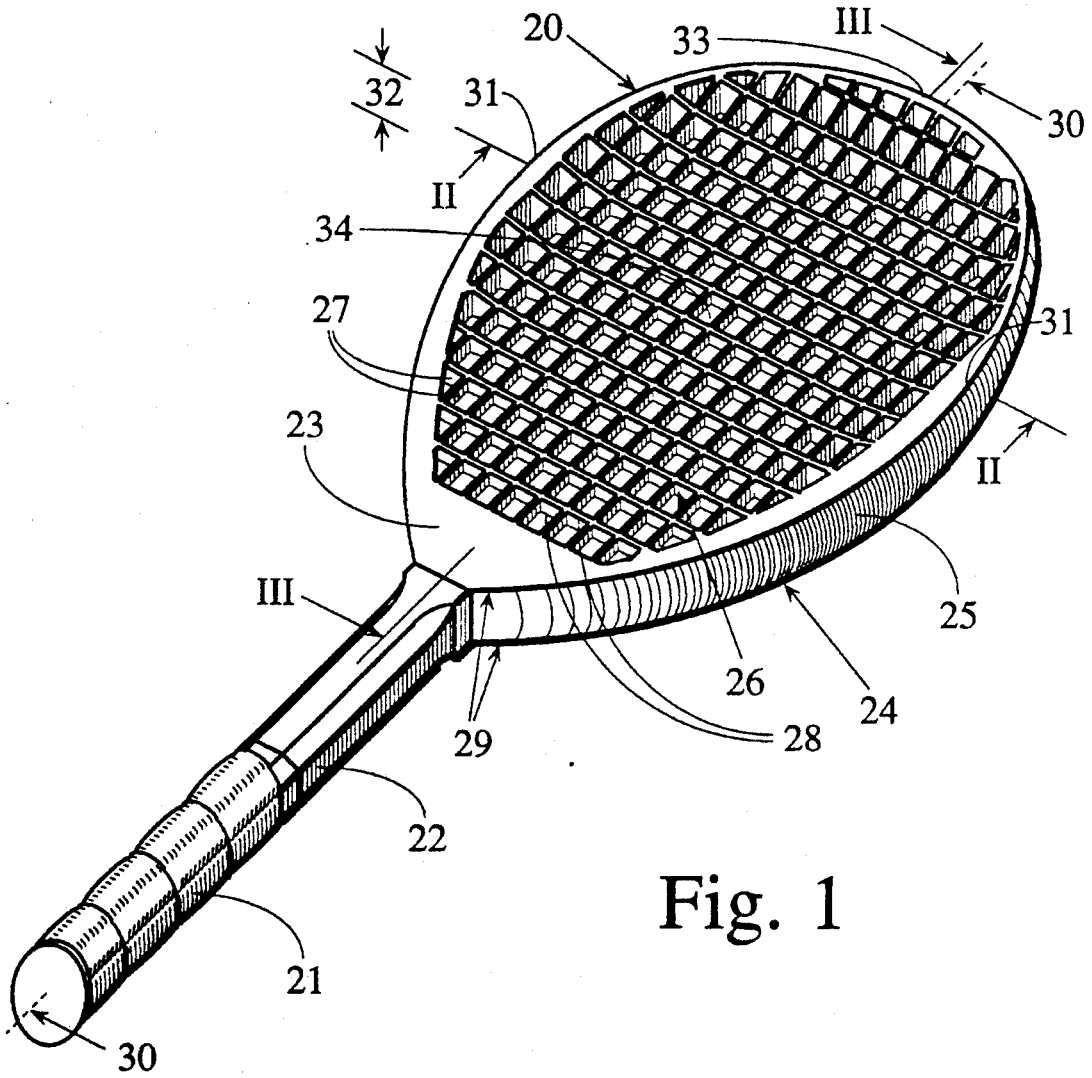
FIG. 1 is a perspective view of a game racket embodying the principles of the present invention.

20: game racket
21: grip
22: handle shaft
23: throat
24: head
25: generally ovoid peripheral bow
26: incurvate open cellular network
27: rectangular, lozenge-shaped or ovoid strips
28: top and bottom edges
29: contact surfaces
30: central longitudinal axis
31: extreme lateral edges
32: greatest thickness
33: extreme end
34: central area
35: central locus
36: maximal surface area
37: minimal aperture area
38: texturable contact surface
39: barbs or cusps
40: striated ridges and grooves
41: small, rounded protuberances
42: grainy, roughened surface
43: front contact surface
44: back contact surface
45: alternative embodiment of game racket
46: enlarged peripheral bow
47: concave outer edge
48: rigid, resilient material
49: interposed vibration-dampening material
50: relatively more pliant material
51: alternative contact surfaces
52: apertures
53: aerodynamic fairing
54: variable height
55: rounded texture knobs
56: ball
57: arrow indicating direction of movement of incoming ball 58: general plane of the head portion of the game racket 59: tangent plane to incurvate contact surface at point of contact 60: point of contact.

DESCRIPTION OF THE PREFERRED EMBODIMENTS

Referring first to FIG. 1, wherein the general features of the present invention are best illustrated, the game racket 20 has the shape and dimensions of a tennis racket, and the invention will be described in relation to a tennis racket. However, it is understood that the invention is applicable to any other game racket such as a racket ball racket or a squash racket.

The game racket 20 comprises a grip 21, a handle shaft 22, a throat 23 and a curvilinear head 24 comprising a generally ovoid peripheral bow 25 and an incurvate open cellular network 26 rigidly held with respect to the bow 25, said incurvate open cellular network in the preferred embodiment being formed by a plurality of intercommunicating rectangular, lozenge-shaped or ovoid strips 27, whose top and bottom edges 28 form the contact surfaces 29. The compensatory curvature of each contact surface 29 continues uninterupted across the top and bottom surfaces of the surrounding peripheral bow 25, which effectively forms the peripheral portions of the contact surfaces 29. Said compensatory curvature provides graded correction for the misalignment of the contact surfaces 29 by the lateral torsional force exerted by an incoming game ball, the lever arm of said lateral torsional force being the distance from the point of contact to the central longitudinal axis 30. The compensatory curvature is greatest at the extreme lateral edges 31 of the peripheral bow 25 farthest from the central longitudinal axis 30. Here also are the points of greatest thickness 32 of the racket head 24.

The gradual increase in curvature toward the extreme end 33 of the contact surfaces 29 farthest from the grip 21 compensates for the secondary torsional force whose lever arm is the distance along the central longitudinal axis 30 from the point of contact to the grip 21.

The incurvate open cellular network 24 is thinnest in the central area 34 where, in this embodiment, there is no corrective curvature; and hence the contact surfaces are parallel to each other as well as to the general plane of the peripheral bow.

Figure 2:
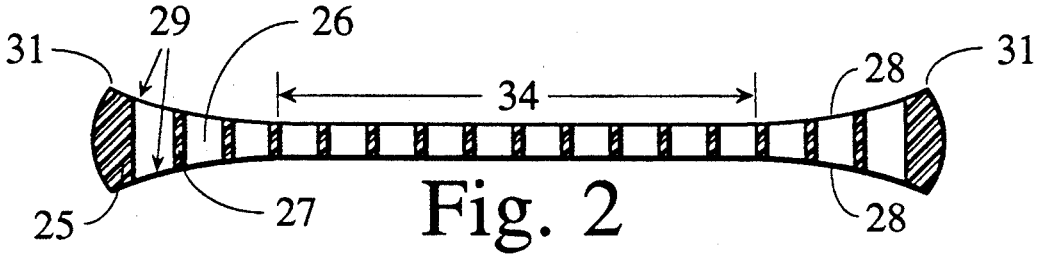
FIG. 2 is a section taken on the line II—II of FIG. 1.

As shown in the cross-sectional view in FIG. 2 taken on the line II—II of FIG. 1, the thickness of the open cellular network 26 and peripheral bow 25 varies from one laterl edge 31 to the other. FIG. 2 also shows the generally rectangular strips 27 which form the incurvate open cellular network 26 and whose top and bottom edges 28 make up the contact surfaces 29. In this embodiment there is a relatively large central area 34 which has no corrective curvature.

Figure 3:
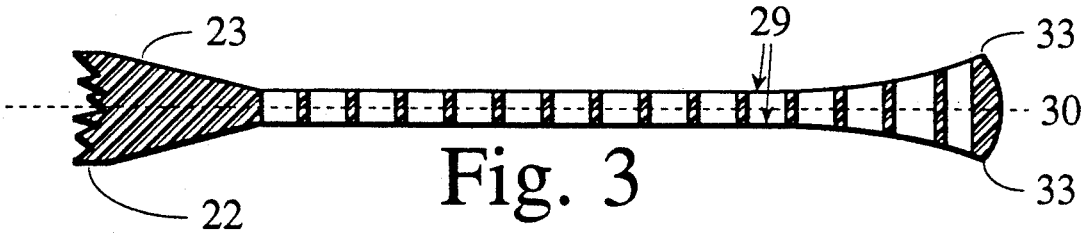
FIG. 3 is a section taken on the line III—III of FIG. 1.

FIG. 3 shows a cross-sectional view along the central longitudinal axis 30 taken on the line III—III of FIG. 1 and illustrates the compensatory curvature for the secondary torsional force, said compensatory curvature producing the greatest thickness between the extreme edges 33 of the contact surfaces 29 farthest from the grip. Also shown are the unplayable throat 23 and a portion of the handle shaft 22.

Figure 4:
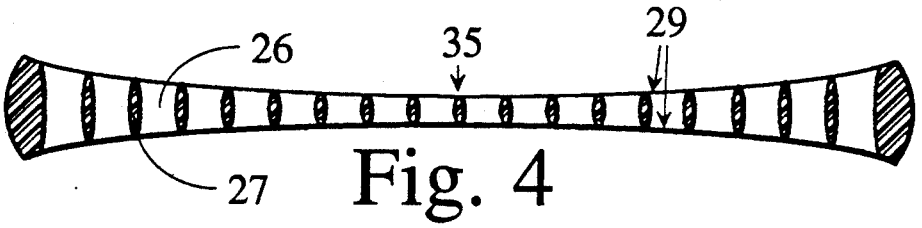
FIG. 4 is a section similar to FIG. 2 illustrating the aerodynamic ovoid cross-section of the open cellular network.

FIG. 4 shows a cross-sectional view similar to FIG. 2 of an alternative embodiment with approximately parabolic contact surfaces 29 and an incurvate open cellular network 26 composed of aerodynamic ovoid strips 27. In this embodiment, there is only one central locus 35 at which planes tangent to both contact surfaces would be parallel.

Figure 5:
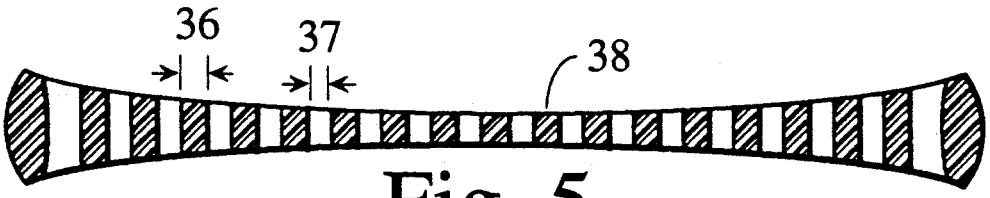
FIG. 5 is a section similar to FIG. 2 showing a modification maximizing the solid area of the contact surfaces.

FIG. 5 is similar to FIG. 4 and illustrates a further alternative embodiment with maximal surface area 36 and minimal aperture area 37, producing a greater area of texturable contact surface 38.

Figure 6:
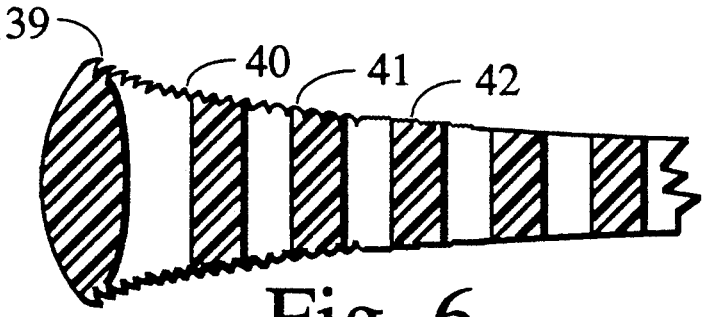
FIG. 6 is a close-up view of a further modification of FIG. 5 showing a number of possible surface textures.

FIG. 6 is a close-up cross-sectional view of the lateral portion of the racket head indicating in no particular sequence several possible surface textures including: barbs or cusps 39; striated ridges and grooves 40; small, rounded protuberances 41; and a grainy, roughened surface 42.

Figure 7:
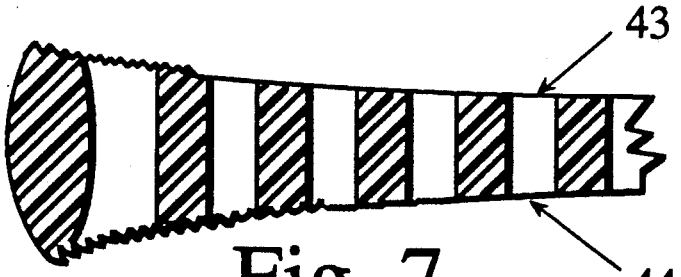
FIG. 7 is a close-up view similar to FIG. 6 illustrating an alternative design of the invention in which the top and bottom contact surfaces have different curvatures and textures for forehand and backhand respectively.

FIG. 7 is similar to FIG. 6, illustrating a further alternative embodiment wherein the front contact surface 43 and the back contact surface 44 have differentiated corrective curvatures and textures such as may be determined to be optimal for forehand and backhand respectively.

Figures 8, 9:
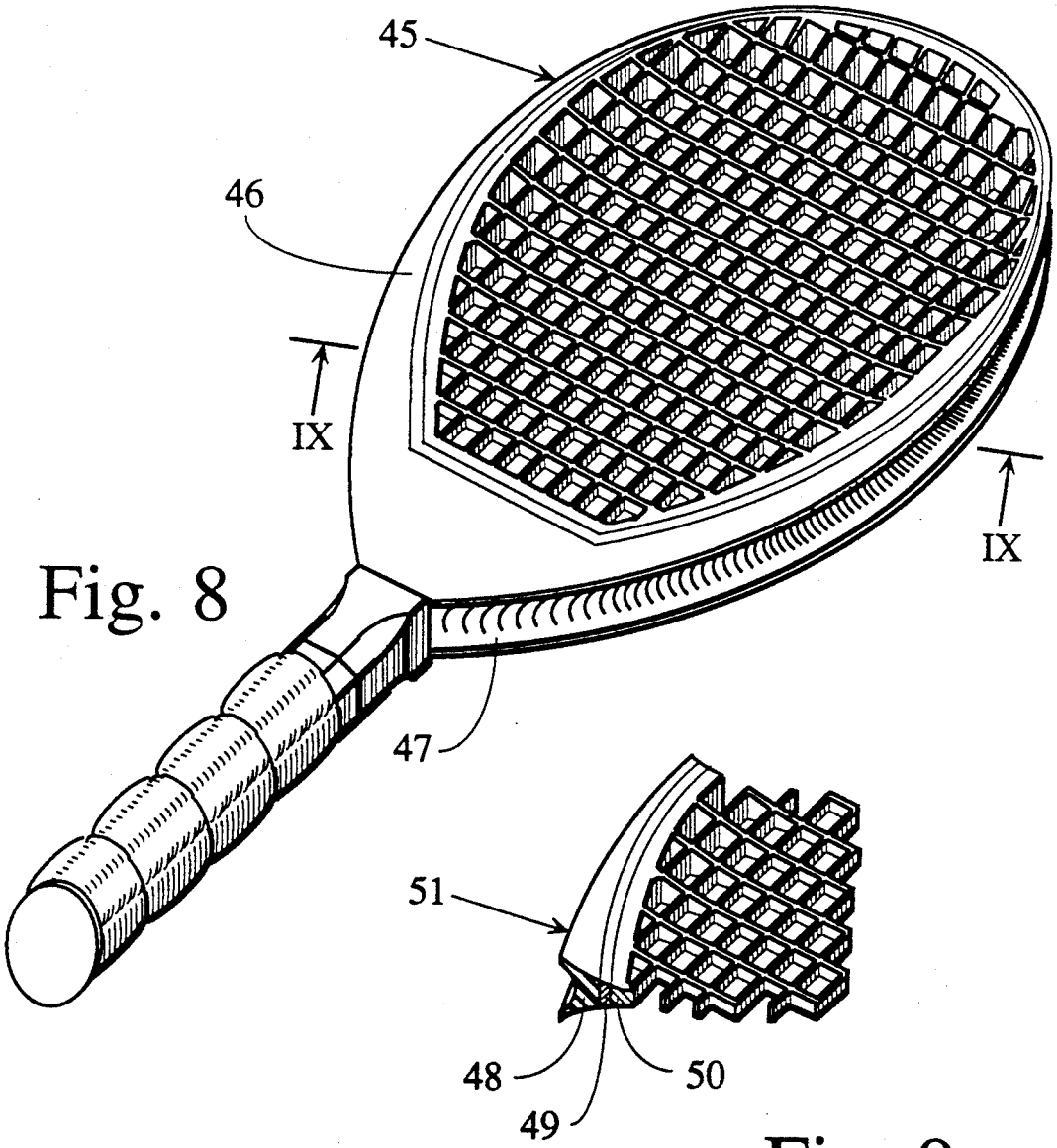
FIG. 8 is a perspective view of a second game racket embodying further principles of the present invention.
FIG. 9 is a perspective view of a fragment of the racket of FIG. 8 illustrating a portion of the section taken on the line IX—IX.

In FIG. 8 an alternative embodiment of a game racket is indicated generally at 45. The game racket 45 has the general shape and dimensions of a racket ball racket. However, it is understood once again that the present invention is applicable to any other game racket such as a tennis racket or squash racket. This game racket 45 is similar to the one described in detail in the description of FIG. 1 and has the following additional features: an enlarged and stronger peripheral bow 46 and a concave outer edge 47 which pares away unnecessary material and decreases the swing weight of the game racket 45.

A further improvement which is intended to mimic the "trampoline effect" of conventional stringing is illustrated in FIG. 9, which shows in cross-section the three materials which are bonded together to make up this embodiment: the rigid, resilient material 48 of the racket frame itself; the interposed vibration-dampening material 49 and the relatively more pliant material 50 forming the incurvate open cellular network. Alternatively, the same figure can be used to illustrate an embodiment wherein a pliant material membrane of variable thickness 50 forming the incurvate open cellular network is held taut by being fastened or bonded to the interposed vibration-dampening material 49 and the surrounding rigid, resilient material 48 of the racket frame under high peripheral tension.

Figure 10:
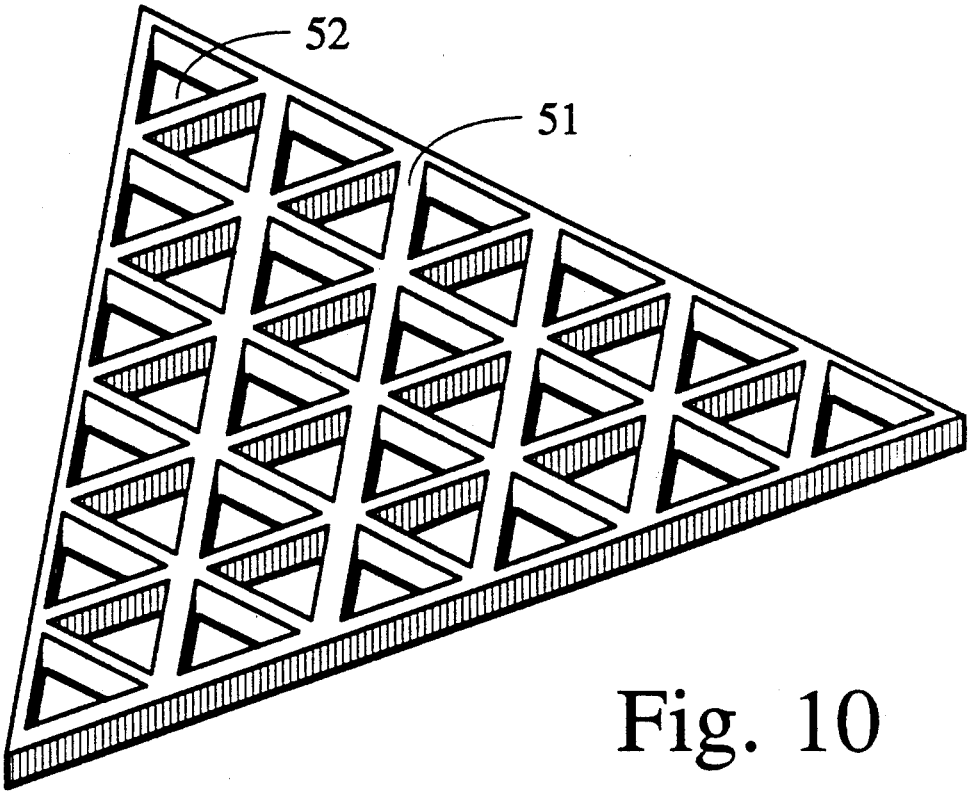
FIGS. 10 and 11 are perspective views of alternative designs for the contact surfaces of the racket.
Figure 11:
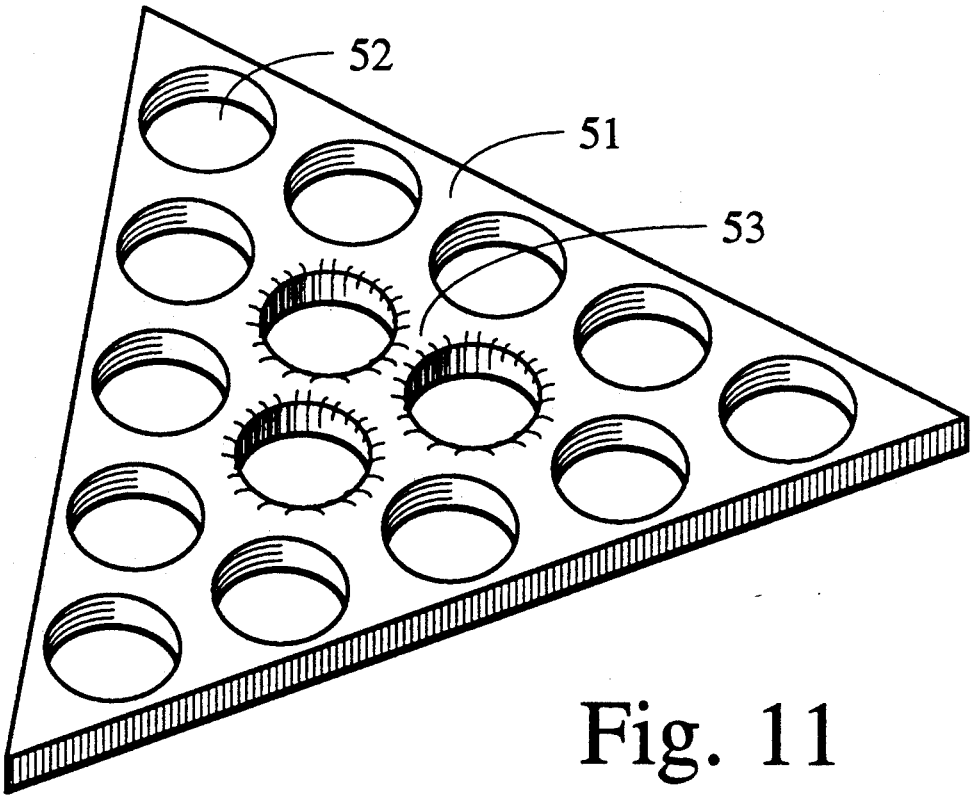

FIGS. 10 and 11 show possible configurations for alternative contact surfaces 51 and apertures 52 for the incurvate open cellular network. Many such configurations comprising patterns of hexagons, triangles, squares, rectangles, circles and ovals are all possible and fall within the scope of the present invention. FIG. 11 also indicates that the apertures can have aerodynamic fairing 53.

Figure 12:
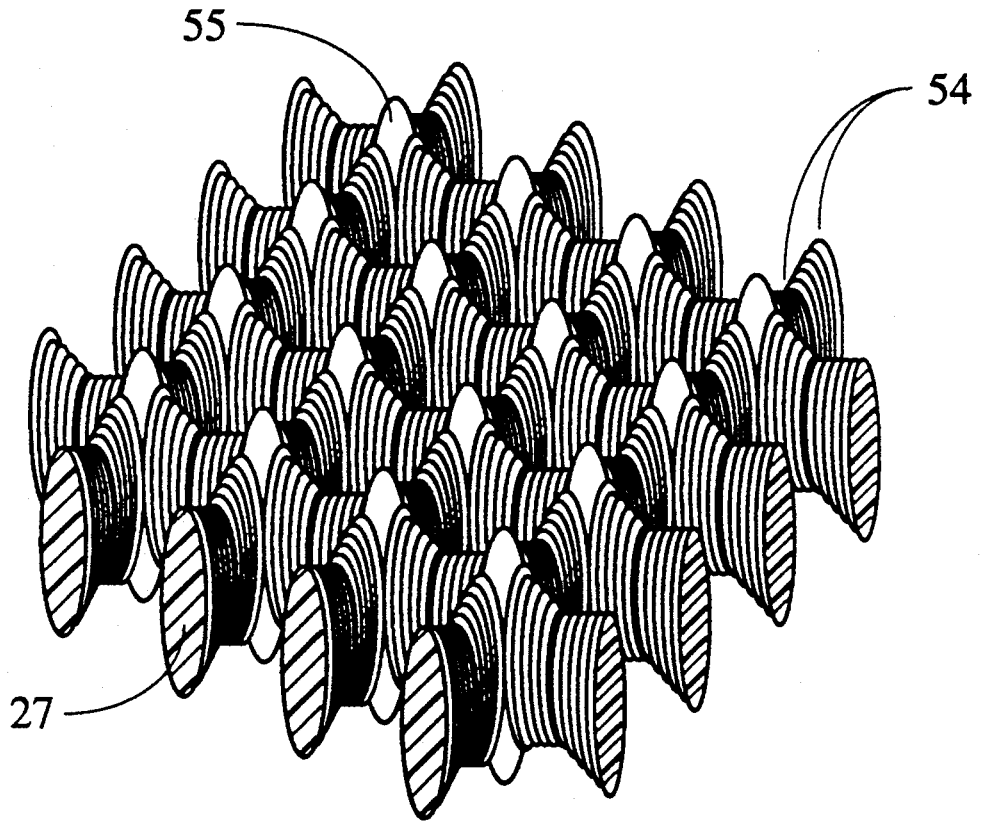
FIG. 12 is a perspective view of the contact surface illustrating the ovoid cross-section of variable thickness and an example of texturing.

In FIG. 12 the preferred embodiment of the incurvate open cellular network is illustrated in a detailed perspective view and shows clearly many of the advantages of the present invention. The ovoid strips 27 are shown in cross-section to illustrate their aerodynamic profile and are of variable height 54 to show another way in which texturing can be added to the contact surfaces. The rounded protruberances 55 at the intersections of the ovoid strips 27 show further means for adding texture.

Figure 13:
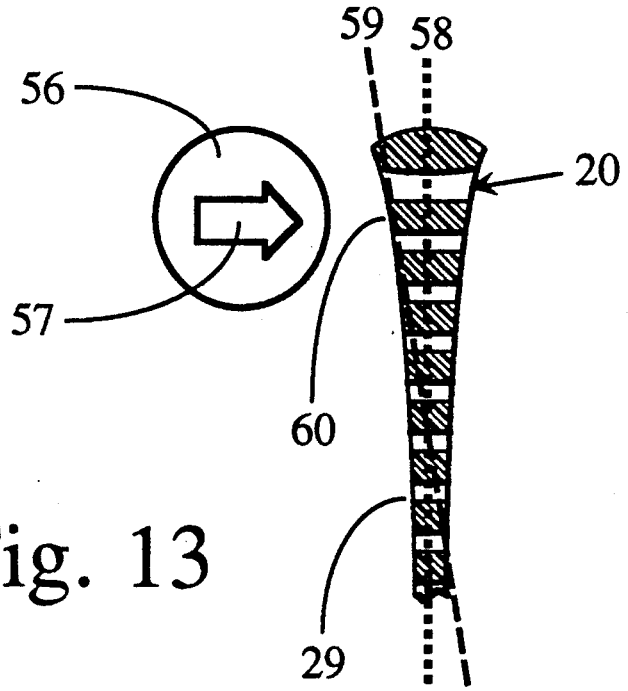
FIGS. 13 and 14 are portions of the section taken on line II—II of FIG. 1 illustrating the operation of the invention.
Figure 14:
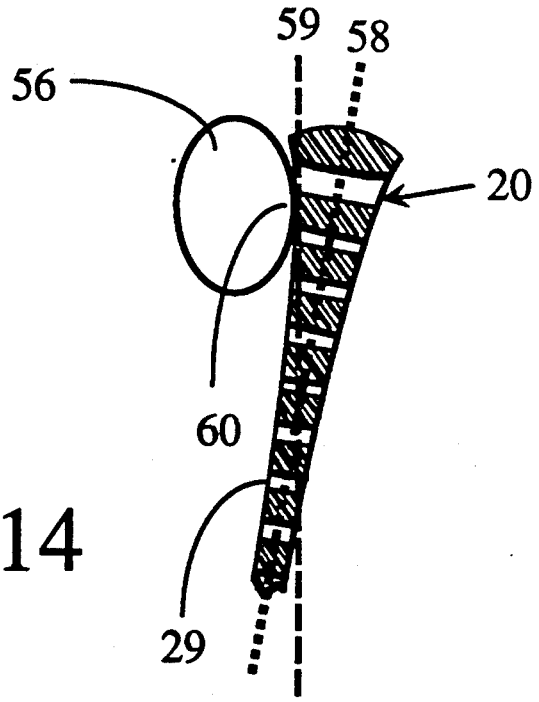

FIGS. 13 and 14 show the present invention in operation. In FIG. 13 the incoming ball 56 is shown with an arrow 57 indicating its direction of movement. The broken line at 58 indicates the general plane of the head portion of the game racket 20 before the incoming ball 56 has struck the contact surface 29. Thus the broken line 58 in FIG. 13 also represents the intended plane of contact. Another broken line at 59 indicates the tangent plane to the incurvate contact surface 29 at the imminent point of contact 60.

FIG. 14 shows the displacement of the general plane 58 of the head portion of the game racket 20 away from the intended plane of contact as a result of the torsional force exerted upon it at the point of contact 60 by the ball 56. Although the general plane 58 of the head portion of the game racket 20 is now out of alignment, the tangent plane 59 to the contact surface 29 at the point of contact 60 has automatically realigned itself and is once again parallel with the intended plane of contact.

CONCLUSION, RAMIFICATIONS, AND SCOPE OF THE INVENTION

Accordingly, the reader will see that the game racket of the present invention introduces a range of innovations not feasible in any prior art racket with conventional strung contact surfaces. By replacing the stringing with two concave, approximately parabolic, open cellular contact surfaces made of one or several resiliant, lightweight materials such as graphite composites or metalic alloys, a game racket is provided which is able to automatically compensate for the torsional forces applied to the racket by an incoming ball hitting anywhere on either contact surface, effectively enlarging the sweet spot area to include the entire racket face. A secondary compensatory curvature in the lengthwise direction adjusts for the secondary torsional force encountered when the ball is hit too far toward the extreme end of the playing surface from the racket's grip end. The parabolic curvature of the racket face can also be exploited to allow smoother and more prolonged contact with the ball and thus greater control in the execution of "sliced" shots involving backspin and top spin. In an alternative design, the two contact surfaces have different curvatures and textures—one optimally configured for forehand shots and the other for backhand. Without the conventional racket's requirement of a cumbersome supporting frame extending some distance above the string surfaces, and with all supporting structures in the present invention being located between the two concave surfaces, the playing surfaces are capable of being extended to the very edges of the racket face.

In addition, the invention provides a racket whose honeycomb-like contact surfaces are made up of aerodynamic strips with ovoid cross-sections, thus decreasing wind resistance as well as swing weight. Alternatively, the ratio of solid contact surface area to aperture area can be increased (said apertures having any conceivable shape and their leading edges having aerodynamic fairing), allowing the surface to be textured in any conceivable manner to assist the player in the execution of shots involving backspin and top spin. Furthermore, the present invention has additional advantages in that it allows rackets with a corrective curvature of the same or a similar design to be used by players of all levels of expertise, regardless of their strength;

it provides a racket which can be held in a more relaxed manner, since the player no longer needs to resist the torsional forces in order to aim accurately, thus decreasing the muscular stresses which often result in injury;

it provides a racket of an alternative design in which the contact surface is made of a material with more elasticity than the frame of the racket and is joined to the racket frame by an intermediate layer of vibration-dampening material;

it provides a further alternative racket design in which a pliant membrane of variable thickness conforming to the above mentioned curvature is held taut by being fastened to the surrounding frame structure under high peripheral tension; and it provides a game racket which is maintenance-free, as there is no necessity for the racket to be restrung every four to six months, as with a conventional racket, or for a player to be continually readjusting the crisscrossing string as it works its way out of alignment during play.

Although the description above contains many specificities, these should not be construed as limiting the scope of this invention but as merely providing illustrations of some of the presently preferred embodiments of the invention. It is obvious that minor changes may be made in the form and construction of the invention without departing from the material spirit thereof. For example, the racket face can have other shapes, such as circular, rectangular, hexagonal, trapazoidal etc.; the racket can be designed without the secondary compensatory curvature in the longitudinal direction; textures can be added to the racket face in various ways, such as by sand-blasting, spraying the contact surfaces with a liquid texturing medium, adhering textural elements to the surfaces with glue, etc.

Thus the scope of the invention should be determined by the appended claims and their legal equivalents, rather than by the examples given.

I claim:

1. A game racket, comprising: a curvilinear head portion, connected to a handle shaft and grip through an intermediate throat portion; said head portion comprising two incurvate contact surfaces; at least said incurvate contact surfaces and the material elements of said head portion lying between said incurvate contact surfaces being perforated by a plurality of apertures for the passage of air through said head portion; said head portion having a nonuniform thickness with one location of least thickness in the central area of said head portion; each of said incurvate contact surfaces having a continuous, smooth corrective curvature wherein the degree of curvature of either of said incurvate contact surfaces at a given point of contact is defined by the angle of inclination of the tangent plane to said incurvate contact surface through said point of contact with respect to the general plane of said head portion as a whole, and wherein said angle of inclination of each of said tangent planes with respect to said general plane of said head portion is equal and opposite to the average angular displacement of said general plane of said head portion away from an intended plane of contact while said racket is swung by a player striking an incoming ball at said point of contact; said angular displacement being caused by torsional forces exerted differentially on said game racket at each of said points of contact by an incoming ball; and wherein said angular displacement at each of said points of contact and the resultant specific corrective curvature of said incurvate contact surfaces are determined empirically as an average across a random sampling of intended users.

2. The game racket of claim 1 wherein the specific corrective curvature of said incurvate contact surfaces is further refined by a computational analysis correlating pertinent data selected from the group consisting of velocities, forces, masses, momenta, friction, air resistance, trajectories and human physiological constraints.

3. The game racket of claim 1 wherein said incurvate contact surfaces have textures selected from the group consisting of barbs; cusps; striated ridges and grooves; small protuberances; grainy, roughened surfaces; textures added to said incurvate contact surfaces by sandblasting; textures sprayed onto said incurvate contact surfaces with texturing medium; and textural elements adhered to said incurvate contact surfaces.

4. The game racket of claim 1 wherein said apertures for the passage of air through said head portion are substantially reduced in size, whereby the texturable contact surface area is substantially enlarged.

5. The game racket of claim 1 wherein said apertures for the passage of air through said head are, as viewed in a direction perpendicular to the general plane of said head portion, of a shape selected from the group consisting of circles, ovals, triangles, squares, rectangles, lozenges, parallelograms, trapezoids and hexagons.

6. The game racket of claim 5 wherein the leading edges of said apertures for the passage of air through said head portion have aerodynamic fairing.

7. The game racket of claim 1 wherein the front contact surface and the back contact surface have differentiated corrective curvatures and textures, whereby a player can readily compensate for both forehand and backhand shots.

8. The game racket of claim 1 wherein said continuous, smooth corrective curvature extends to the extreme peripheral edges of said head portion.

9. The game racket of claim 1 wherein said head portion comprises a peripheral bow which surrounds and is joined to said incurvate contact surfaces; the upper and lower surfaces of said bow being shaped to extend said continuous, smooth corrective curvature from said incurvate contact surfaces onto and across said upper and lower surfaces of said bow.

10. The game racket of claim 9 wherein said peripheral bow has a concave outermost edge surface joining the extreme peripheral edges of one of said incurvate contact surfaces to the extreme peripheral edges of the other of said incurvate contact surfaces, whereby the weight of the racket is substantially decreased.

11. The game racket of claim 9 wherein said incurvate contact surfaces are made of a pliant material and which are joined to said peripheral bow under extreme peripheral tension.

12. The game racket of claim 1 wherein said head portion comprises a peripheral bow and an interposed layer of vibration-dampening material joining said peripheral bow to said incurvate contact surfaces.

13. The game racket of claim 1 wherein said head portion comprises a peripheral bow integral with said incurvate contact surfaces.

14. The game racket of claim 1 wherein said game racket comprises material elements with vibration-dampening properties.

15. The game racket of claim 1 wherein at least said material elements of said head portion lying between said incurvate contact surfaces are reinforced with resilient filaments.

16. The game racket of claim 1 wherein said head portion comprises a peripheral bow and wherein said material elements of said head portion lying between said incurvate contact surfaces are reinforced with resilient filaments attached under extreme peripheral tension to said peripheral bow.

17. The game racket of claim 1 wherein said head portion comprises an open cellular network or honeycomb-like matrix of interconnected strips; said interconnected strips having a continuously variable height dimension as measured along the length of the strips; the top and bottom edges of said interconnected strips forming said continuous, smooth corrective curvature across said incurvate contact surfaces; said interconnected strips having a cross-section generally conforming to a shape selected from the group consisting of rectangular, lozenge-shaped, and ovoid.

18. The game racket of claim 17 wherein at least said open cellular network or honeycomb-like matrix of interconnected strips is reinforced with resilient filaments.

19. The game racket of claim 17 wherein said head portion comprises a peripheral bow and wherein said open cellular network or honeycomb-like matrix of interconnected strips is reinforced with resilient filaments attached to said peripheral bow under extreme peripheral tension.

20. The game racket of claim 17 wherein each of said interconnected strips has a series of cross-sections taken along its length; said cross-sections exhibiting a periodically variable height dimension; the points of intersection of said interconnected strips forming textural protuberances which extend above said incurvate contact surfaces.

* * * * *